United States Patent [19]

McCormick et al.

[11] 4,342,249

[45] Aug. 3, 1982

[54] STRING MOUNTING PITCH CHANGING APPARATUS FOR A PEDAL STEEL GUITAR

[76] Inventors: Robert C. McCormick; Tom H. McCormick, both of 1100 N. Union Bower, Irving, Tex. 75061

[21] Appl. No.: 217,343

[22] Filed: Dec. 15, 1980

[51] Int. Cl.[3] ..... G10D 3/14

[52] U.S. Cl. ..... 84/312 P

[58] Field of Search ..... 84/312 R, 312 P, 313, 84/314 N

[56] References Cited

U.S. PATENT DOCUMENTS

| | | | |
|---|---|---|---|
| 3,440,920 | 4/1969 | Norwood | 84/312 P |
| 3,748,943 | 7/1973 | Lashley | 84/312 P |
| 4,077,296 | 3/1978 | Mullen | 84/312 P |
| 4,157,050 | 6/1979 | Lashley | 84/312 P |

FOREIGN PATENT DOCUMENTS

| | | | |
|---|---|---|---|
| 2745636 | 4/1979 | Fed. Rep. of Germany | 84/312 R |

*Primary Examiner*—Lawrence R. Franklin
*Attorney, Agent, or Firm*—Robert K. Rhea

[57] ABSTRACT

In a pedal steel guitar a plurality of pivotally interconnected levers, selectively moved by the pedals, are connected with the quitar string ends opposite the neck end of the guitar for effecting string pitch changes. Vertically movable posts, each supporting a pulley over which the respective string is entrained, are disposed adjacent the neck end of the guitar for positioning the upper surface of all the strings in a common plane.

2 Claims, 8 Drawing Figures

STRING MOUNTING PITCH CHANGING APPARATUS FOR A PEDAL STEEL GUITAR

BACKGROUND OF THE INVENTION

1. Field of the Invention

The present invention relates to an improved pitch changing means for a stringed instrument and more particularly to a pedal actuated pitch changing assembly for raising and lowering the pitch of individual strings from their normal or tuned pitch, including means for maintaining the uppermost surface of the several strings in a common horizontal plane in that area overlying the fret board.

It is common practice to tune the strings of a pedal steel guitar in a particular chord, usually referred to as the "open" tuned condition in which the tuning or tension on the strings is adjusted without the foot pedals being depressed. After the strings have been tuned in the open condition it is returned with selected pedals associated with respective strings in an actuated position to produce a certain note for the respective string different from that obtained in the open condition. The term "pedal" as used herein, refers to knee, hand, foot or other lever operated pedals for obtaining tone variations, either a higher or a lower tone from the tuned open condition of the string.

2. Description of the Prior Art

U.S. Pat. No. 4,157,050 discloses a tone adjusting mechanism for the strings of a guitar in which pedal actuated raising and lowering string tone changing levers, pivoting about a common support rod, are moved in a string tightening or loosening manner by raising and lowering levers separately connected at one end with the guitar frame member so that depression of a selected pedal or pedals pivots the tone changing lever about the axis of the lever rod.

This invention is distinctive over this patent by providing a plurality of overlapping juxtaposed pivotally interconnected levers actuating a string puller arm in which the several levers are generally vertically disposed and supported by the guitar frame and project above and below the horizontal plane thereof through an opening in the frame.

Other patents disclosing lever operated string tension apparatus generally elevate or lower a particular string in response to the depression of a connected lever, such that the activated string is disposed above or below the plane common to the remaining strings.

This invention further features string height adjustment of the spacing between the strings and the upper surface of the frame located adjacent the peg adjusting screws at the neck end of the guitar for individually elevating or lowering the peg connected end portion of the respective string so that its uppermost surface lies in a plane common to all the strings.

SUMMARY OF THE INVENTION

A plurality of juxtaposed generally vertically disposed plates extend in bridge fashion transversely of a guitar through an opening in its frame opposite its neck end. A pair of string tightening and loosening levers are pivotally connected with the respective plates. A plurality of puller arms, one for each string, interposed between the plates are pivotally interconnected at one end with the levers and features an upper part-circular arcuate surface over which the respective string passes and is secured thereto. Pedals are connected with the respective levers, and pivots the upper end portion of the puller arm toward and away from the neck end portion of the guitar in a string tensioning and loosening action for tone adjustment in response to depression of a pedal connected with the levers. Harmonic tone adjusting means is connected with the upper end portion of the respective puller arm.

A plurality of juxtaposed vertically adjustable posts supporting a like plurality of pulley-like rollers, one for each string, extend transversely of the guitar adjacent its neck end for adjusting the spacing between the respective string and the upper surface of the guitar.

The principal object of this invention is to provide a steel guitar string supporting and tone changing apparatus which may be attached to and used in conjunction with steel guitars of the pedal type which includes vertical adjustment of the horizontal plane of respective strings, harmonic balance tuning and single rod tuning.

DESCRIPTION OF THE PREFERRED EMBODIMENT

Figures 1, 4:
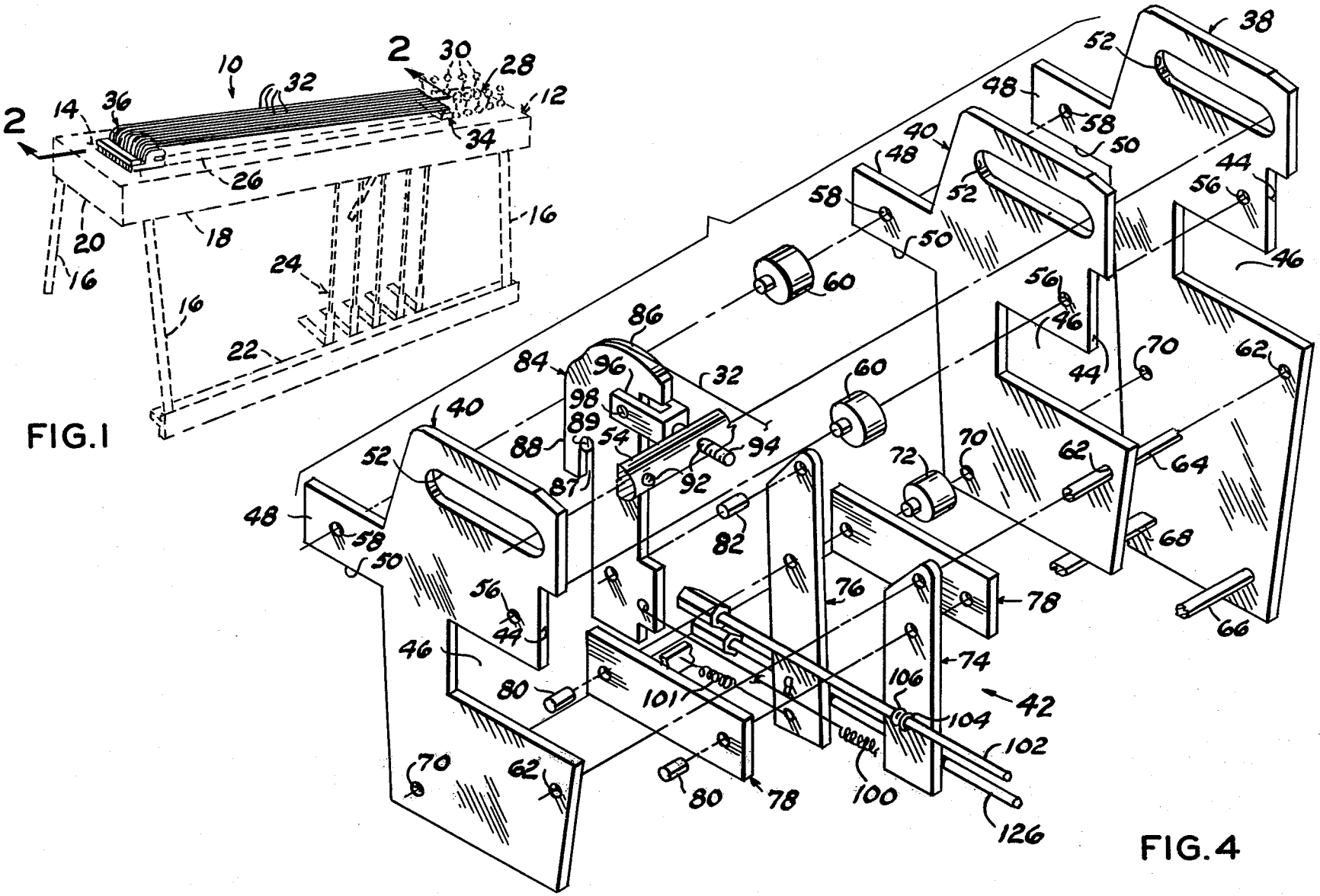
FIG. 1 is a dotted line perspective view of a conventional steel guitar illustrating, by dotted lines, the strings and relative position of the tone changing and string adjusting means when connected therewith.
FIG. 4 is a fragmentary exploded perspective view illustrating the several string tightening and loosening components associated with one string.

Like characters of reference designate like parts in those figures of the drawings in which they occur.

In the drawings:

Referring to FIG. 1, the reference numeral 10 indicates a pedal steel guitar formed by a horizontal frame 12 having a top 14, hereinafter referred to as a base, supported by a plurality of vertically adjustable legs 16. The frame 12 includes depending side and end flange members 18 and 20 which support and conceal pedal actuated lever activators and connecting rod assemblies. A cross member 22 extends between the depending end portions of the front legs and supports a pedal mechanism 24 for connection with the rod and activator assemblies, as presently described.

The top surface of the base 14 supports a fret board 26 and an electronic pickup, not shown. One end of the base supports a key head 28 provided with a plurality of string connecting tune keys or pegs 30. The guitar strings 32 are connected at one end with the respective key 30, over a bridge-like string elevating assembly 34, as presently described, and extend in parallel relation longitudinally of the base and are connected at their other ends with a like plurality of puller arms forming a part of a plate assembly 36, as will now be described.

Figure 2:
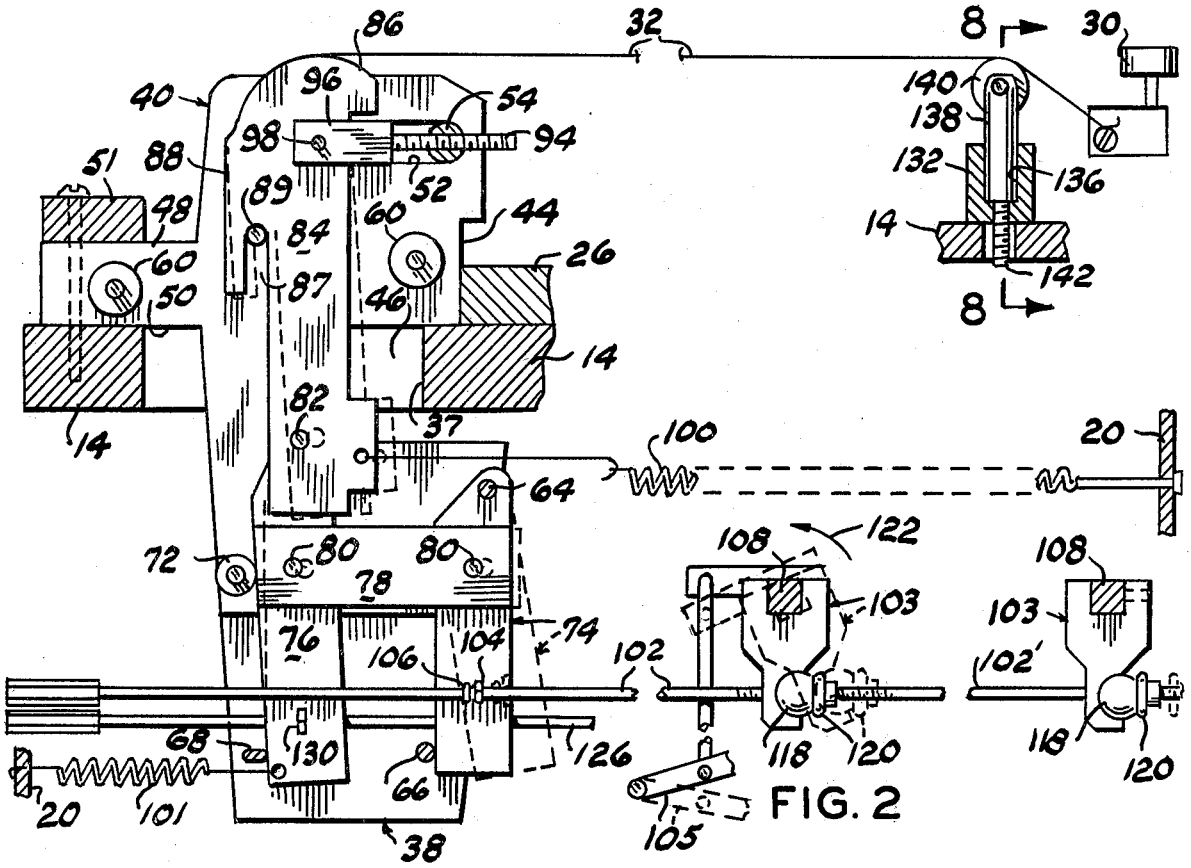
FIG. 2 is a fragmentary vertical cross sectional view, to a larger scale, partially in elevation, taken substantially along the line 2—2 of FIG. 1 illustrating, by dotted lines, the relative position of the raising levers and puller arm in a string tension position.
Figure 3:
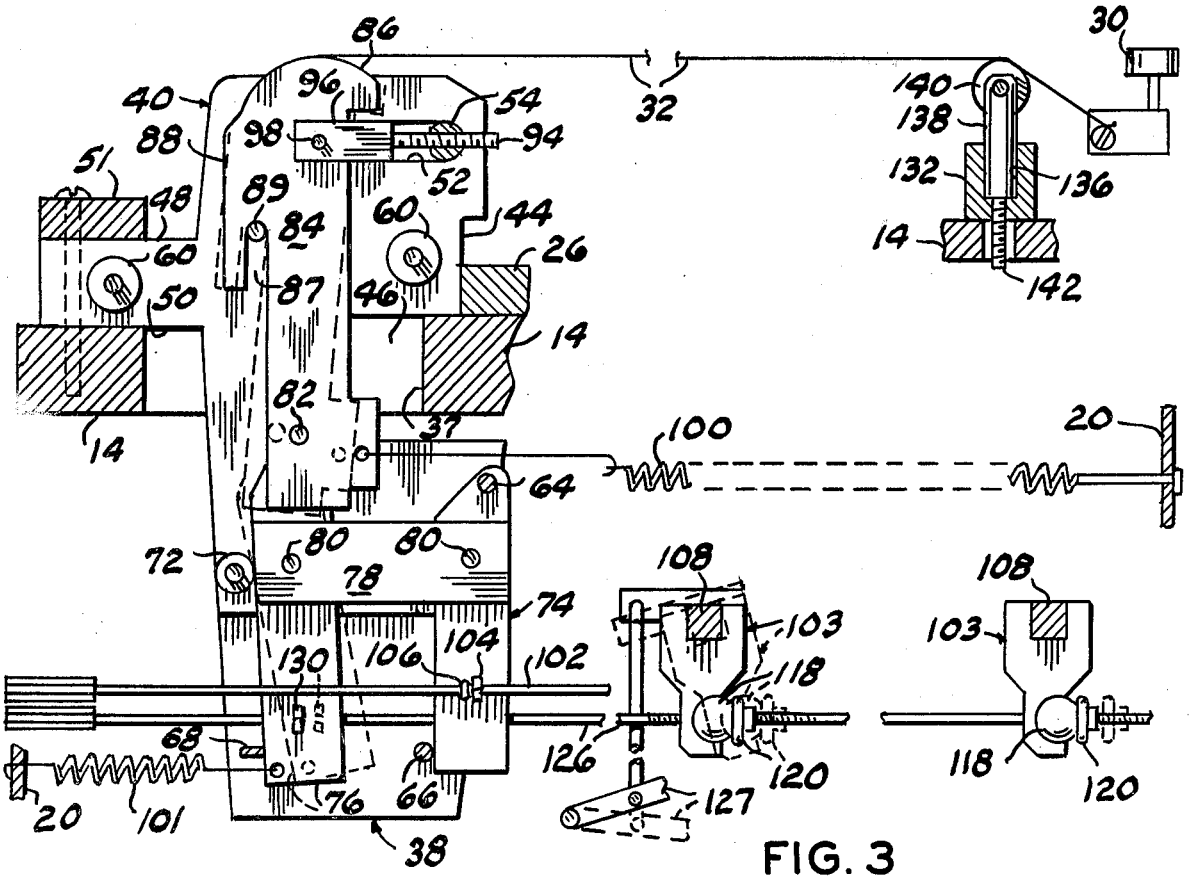
FIG. 3 is a view similar to FIG. 2 illustrating, by dotted lines, the relative position of the lowering lever and puller arm in string loosening position.
Figure 7:
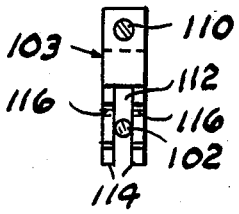
FIG. 7 is an elevational view of the lever activator looking in the direction of the arrows 7—7 of FIG. 6; and, FIG. 8 is a fragmentary vertical cross sectional view taken substantially along the line 8—8 of FIG. 2.

Referring also to FIGS. 2, 3 and 4, the plate assembly 36 comprises a plurality of juxtaposed plates extending transversely of the guitar frame with each plate parallel with the longitudinal axis of the guitar and projecting vertically above and below the frame base 14 through an opening 37 therein opposite the peg or neck end of the guitar. The assembly of juxtaposed plates are defined by a pair of identical end plates 38, only one being shown in detail, and a plurality of inner plates 40. A puller arm assembly 42, one assembly for each of the strings 32, is interposed between each two adjacent inner plates 40 in the manner presently described.

The end plate 38 is characterized by a front edge surface 44 facing the neck end of the guitar which abuts the rearward edge of the fret board 26. A rectangular opening 46 is cut in the plate below the edge 44 and receives an edge portion of the base 14 defining the forward limit of the opening 37 for supporting the end plate. The end plate is further provided with a rearwardly projecting rectangular portion 48 having a horizontal lower surface 50 which overlies an edge portion of the base 14 defining the rearward limit of the base opening 37. A clamp block 51, secured by screws to the base 14, overlies the projection 48 to further anchor the plate to the base. Adjacent its upper limit, the end plate is provided with an elongated horizontally disposed slot 52 which receives and nests, at its forward limit, one end portion of an elongated harmonic tuning bar 54 extending transversely between the end plates. Spaced above its recess 46 and depending surface 50, the end plate is provided with transverse bores 56 and 58 for receiving the respective axle of a pair of spacers 60, for the reasons presently apparent.

A third spacer axle receiving bore 70 is formed in the end plate adjacent its rearward limit and spaced below its opening 46 for receiving a third spacer 72.

Adjacent its forward edge and spaced below its recess 46, the end plate 38 is provided with another transverse bore 62 which receives one end portion of an elongated rod-like shaft 64 extending between the end plates. Similarly, a second elongated stop rod 66 extends between the end plates adjacent its forward edge and lower limit. The third rod, forming a stop bar 68, extends between the end plates adjacent its rearward surface and lower limit.

The inner plates 40 are formed identical with respect to the end plate 38 and bear identical reference numerals with the exception they terminate downwardly of the third spacer bore 70 and above the rod 66 and bar 68. The inner plates 40 are similarly supported within the base opening 37 and by the shaft 64 extending through the respective inner plate. The tuning bar 54 similarly projects through the forward end portion of the respective elongated slot 52 in each inner plate.

The puller arm assembly 42 comprises a pair of vertically disposed generally parallel levers defining a forwardly disposed raising lever 74 and a rearwardly disposed lowering lever 76 pivotally interconnected in a substantially H-shaped configuration by a pair of links 78 horizontally disposed on opposing sides of the raising and lowering levers. The upper end portion of the raising lever 74 is apertured for receiving the plate supporting shaft 64 about which the raising lever is pivoted, as presently explained. The depending end portion of the raising lever 74 is disposed forwardly of stop rod 66 and similarly the depending end portion of the lowering lever 76 is disposed forwardly of the stop bar 68. The upper end of the lowering lever 76 terminates adjacent the depending limit of the inner plates opening 46 and is pivotally connected by a pin 82 with the depending end portion of an elongated substantially strap-like puller arm 84.

Figure 5:
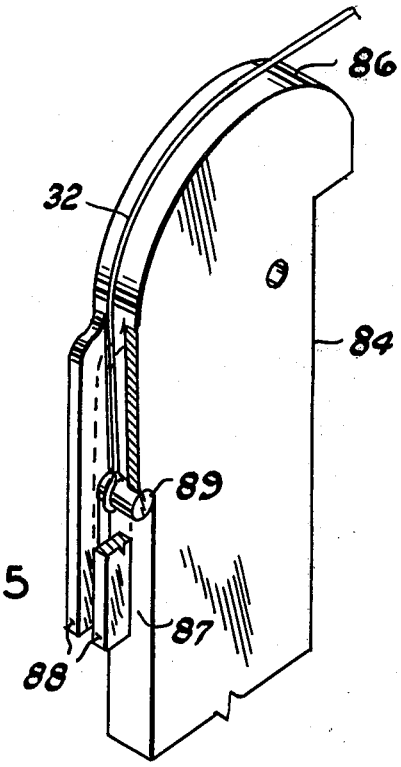
FIG. 5 is a fragmentary perspective view, to an enlarged scale, illustrating the manner of connecting one end of a string to a puller arm.
Figure 6:
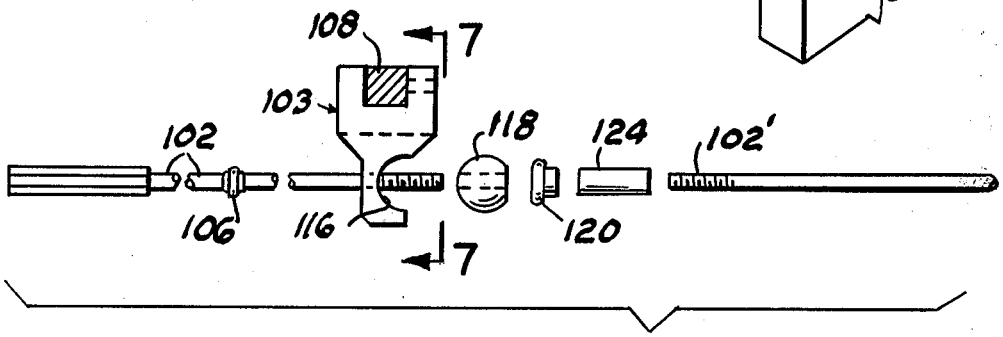
FIG. 6 is a fragmentary exploded view of a pedal actuated lever activator and its associated rod assembly.
Figure 8:
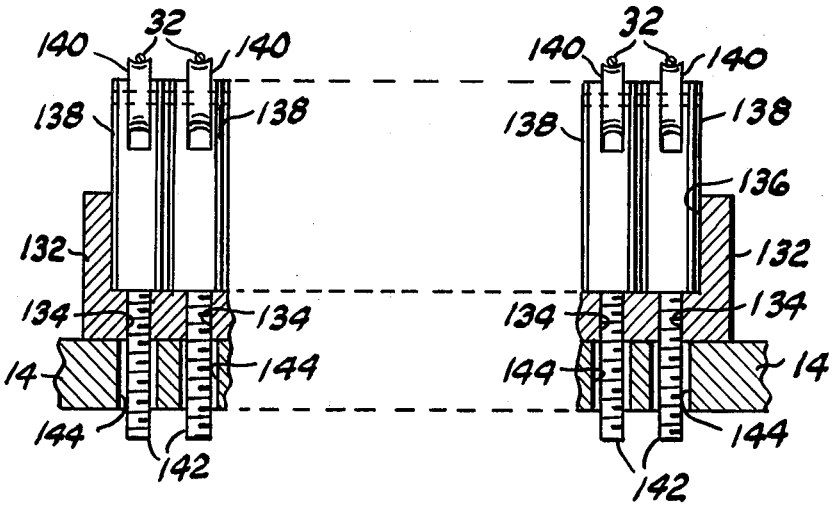

The puller arm 84 projects upwardly above the upper limit of a horizontal plane defined by the upper end surface of the respective end and inner plates 38 and 40, in the plane of the respective string, and is characterized by an arcuate part-circular upper end surface 86 over which the end portion of the respective guitar string 32, opposite its peg connected end, is entrained. The rearward edge surface of the puller arm is provided with a downwardly open slot 87 terminating at its upper limit below the arcuate surface 86. The upper rearward edge portion 88 of the puller arm is vertically bifurcated (FIG. 5) and communicates with the slot 87 for receiving an end portion of the respective string 32 and anchoring it to the respective puller arm by a dowel 89 extending transversely through the upper limit of the slot 87.

The part-circular, in transverse section, harmonic tuning bar 54 is transversely apertured and threaded, as at 92, for receiving harmonic tuning adjusting screws 94 which are each connected with a horizontal U-shaped yoke 96 straddling the forwardly disposed upper edge portion of the puller arm and pivotally connected with the puller arm by a pin 98. A portion of the respective opposing legs of the yoke 96 are slidably received by the elongated slots 52 in the inner plates 40 thus supporting the puller arm 84 and permitting it to pivot about the axis of the pin 98 as the puller arm is moved in a string tightening or loosening action, as presently explained. The depending end portion of the puller arm 84 is normally biased forwardly by a spring 100 connected thereto and connected at its other end to the frame neck end flange 20. A spring 101, extending between the depending end of the lowering lever 76 and the adjacent guitar end flange, biases the lowering lever 76 against the stop bar 68 and, by its connection, with the raising lever 74 through the links 78, biases the depending end portion of the raising lever 74 against the stop rod 66. A horizontally disposed raising lever rod 102 is connected, intermediate its ends, with at least one activator 103 moved by one of the pedals 105 of the pedal mechanism 24. One end portion of the rod 102 is connected with the raising lever 74 by a clip 104. A ferrule 106 surrounds the rod 102 and abuts the spring clip 104 for moving the lever 74 to its dotted line position (FIG. 2) when the rod 102 is moved longitudinally by the pedal 105, as presently explained.

A plurality of horizontal activator bars 108, at least one for the respective pedal, extend transversely of the guitar between its side flanges 18. The activator bars 108 are preferably square in transverse section and are suitably journalled at their ends for angular rotation about their longitudinal axis with this angular rotation induced by conventional lever means connecting these bars with the respective pedals. The activator 103 is characterized by a U-shaped end portion which straddles one of the activator bars 108, intermediate its ends, and is held thereon in clamp fashion by a screw 110. The other end portion of the activator 103 is bifurcated to form a slot 112 rotated 90° with respect to the axis of the bar 108 which straddles the rod 102 intermediate its ends. The activator legs 114, formed by the slot 112, are provided with cooperating part-circular recesses 116 facing toward the neck end of the guitar which respectively nest a peripheral portion of a diametrically bored part-spherical pivot 118 surrounding the rod 102.

A nut-like clutch 120, threadedly received by the rod 102, abuts the pivot 118 on its side opposite the activator leg recesses 116 for the purpose of axially moving the rod 102 by a pedal action angularly rotating the activator bar 108 and associated activator 103 in the direction of the arrow 122 (FIG. 2).

More than one activator 103 may be connected with the respective lever raising rod 102 by extending the rod longitudinally of the guitar, as by adding a rod extension 102', which is axially joined to the rod 102 by a coupling 124 and then similarly installing a second or third activator 103 on the rod 102' by using additional pivots and clutch nuts.

A lowering lever rod 126, similarly connected with one of the pedals 127 of the pedal mechanism 24, is similarly secured with the depending end portion of the lowering lever 76 by a spring clip 130 for forward movement of the depending end portion of the lowering lever to its dotted line position (FIG. 3) in a string loosening action, as hereinafter explained.

The bridge-like roller assembly 34 comprises an elongated bar 132 transversely overlying the frame base 14 adjacent the tuning head 28. The bar 132 is provided with a plurality of bores 134 and upwardly open juxtaposed counterbores 136 forming sockets for nesting the depending end portion of a like plurality of posts 138, one for each string, which are vertically slidable in the respective socket. The upper end portion of the respective post 138 is bifurcated and transversely drilled for journalling a pulley-like roller 140 over which the respective string 32 is entrained. The respective bores 134 are threaded for receiving adjusting screws 142 for raising and lowering the respective posts and disposing the upper surface of the strings 32 in a common horizontal plane, as presently explained. The frame base 14 is cooperatively vertically drilled as at 144, for loosely receiving the respective adjusting screws 142.

OPERATION

In operation, the plate assembly 36 and string elevating assembly 34 are installed on the guitar, as described hereinabove. The strings 32 are connected with the respective puller arm 84 and its associated peg 30. The string elevating posts 138 are vertically adjusted by the screws 142 so that the upper surface of all of the strings lie in a common horizontal plane.

The strings are then tuned in the open position by adjustment of the pegs 30 in a conventional manner.

Harmonic tuning of the strings, to eliminate frequency imbalance, is accomplished by adjustment of the screws 94 pivoting the upper end portion of the respective puller arm 84 toward or away from the neck end of the guitar in a string tensioning or loosening action.

With the raising lever and lowering rods 102 and 126 connected with the respective raising and lowering levers 74 and 76 and connected with selected pedals by the activators 103, the several strings are then tuned for producing a higher note than its previously tuned condition wherein a selected pedal axially moves the rod 102 and the raising lever 74 to its dotted line position of FIG. 2 thus similarly pivoting the depending end portion of the puller arm forwardly and placing the associated string under a higher tension to produce the higher note. The magnitude of movement imparted to the raising lever and puller arm is selectively adjusted by the position of the clutch nut 120 relative to the pivot 118 and activator 103 on the rod 102.

Similarly, the string being tuned may be tuned to produce a lower note than its open tuned condition by the depression of a selected pedal connected with the lowering lever rod 126 which pivots the lowering lever 76 to its dotted line position of FIG. 3 and similarly pivots the depending end portion of the puller arm 84 rearwardly and decreases the tension of the associated string. The magnitude of the movement of the lowering lever and puller arm is selectively adjusted to produce the desired note by adjustment of the clutch nut 120 on the lowering rod 126.

Split tuning of any one of the strings 32 may be achieved by separately connecting both the raising lever rod 102 and lowering lever rod 126 by a pair of the activators 103 mounted on one of the activator bars 108 and angularly rotated by a pedal. This is accomplished by adjusting the clutch nuts 120 so that both the raising lever 74 and lowering lever 76 are moved a selected distance toward their respective dotted line positions of FIGS. 2 and 3 thus disposing the puller arm in a position intermediate its previously adjusted string tightening and loosening positions. Thus, one rod may be used to produce a higher, a lower and a split tuned note with respect to the open tuned condition of a string.

Obviously the invention is susceptible to changes or alterations without defeating its practicability. Therefore, we do not wish to be confined to the preferred embodiment shown in the drawing and described herein.

We claim:

1. In combination with a pedal steel guitar having a string secured at one end portion to a string tightening peg at the neck end of the guitar and having an opening in its other end, the improvement comprising:

plate assembly means including a plurality of pivotally interconnected levers extending vertically through the guitar opening for mounting and controlling the tension of said string, said plate assembly means including a displaceable puller arm having an arcuate surface over which the other end portion of said string passes, a pair of end plates disposed in parallel spaced-apart relation transversely of said guitar, a pair of inner plates interposed between said end plates in parallel spaced-apart relation, a stop rod and a stop bar extending horizontally between said end plates, below said inner plates, in parallel spaced-apart relation, a shaft extending transversely through said end plates and said inner plates in vertically spaced relation above said stop rod, a raising lever interposed between said inner plates and pivotally connected at its upper end portion with said shaft for vertical swinging movement of its lower end portion toward and away from the guitar neck end, a lowering lever interposed between said inner plates adjacent said raising lever and pivotally connected at its upper end portion with the depending end portion of said puller arm, a generally horizontal link pivotally connected at its respective end portions with said raising lever and said lowering lever intermediate their ends, and, spring means normally biasing the depending end portion of said puller arm toward the guitar neck end and normally biasing the depending end portion of said raising lever and said lowering lever toward said stop rod and said stop bar, respectively;

means for securing the string to said puller arm;

means for displacing said puller arm in predetermined directions to selectively vary the tension of said string, said displacing means including at least one axially movable elongated rod, a pedal actuated pivotable activator, a clip securing at least one said movable rod to said raising lever and said lowering lever, respectively, and, a ferrule surrounding the respective said movable rod and contacting said clip in response to axial movement of said movable rod in one direction;

means for selectively coupling said rod and said activator for selectively controlling displacement of said puller arm in a predetermined direction of predetermined magnitude by axial movement of said movable rod and consequently the tone of said string; and, harmonic string tuning means transversely supported by said end plates and said inner plates including a pivot pin projecting transversely through and pivotally supporting said puller arm during its displacement in said predetermined directions, said end plates and said inner plates each being provided with a horizontal slot in their upper end portions in cooperative horizontally aligned relation transversely of said guitar, said harmonic tuning means further including a tuning bar extending through the horizontal slots, a yoke having transversely apertured legs straddling an intermediate portion of said puller arm for receiving said pivot pin, and, a harmonic adjusting screw threadedly extending through said tuning bar and abutting said yoke for discrete displacement of said puller arm in said predetermined directions.

2. The combination according to claim 1 and further including:

string height adjusting means extending transversely of the guitar adjacent its neck end, said adjusting means including a bridge bar having at least one vertical threaded bore and having a counterbore forming an upwardly open socket, a post vertically slidable in the socket, said post having a bifurcated upper end journalling a pulley over which said string is entrained, and, a post adjusting screw within the threaded bore.

* * * * *